US008847711B2

(12) United States Patent
Wright et al.

(10) Patent No.: US 8,847,711 B2
(45) Date of Patent: Sep. 30, 2014

(54) RF COAXIAL TRANSMISSION LINE HAVING A TWO-PIECE RIGID OUTER CONDUCTOR FOR A WELLBORE AND RELATED METHODS

(75) Inventors: Brian Wright, Indialantic, FL (US); Murray Hann, Malabar, FL (US); Raymond Hewit, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 213 days.

(21) Appl. No.: 13/568,413

(22) Filed: Aug. 7, 2012

(65) Prior Publication Data

US 2014/0043115 A1 Feb. 13, 2014

(51) Int. Cl.
*H01P 3/06* (2006.01)
*H01P 11/00* (2006.01)

(52) U.S. Cl.
CPC ..... *H01P 3/06* (2013.01); *H01P 11/005* (2013.01)
USPC ..... 333/243; 333/244; 333/260; 340/854.9; 166/248

(58) Field of Classification Search
CPC ..... H01P 3/06; H01P 11/005
USPC ..... 333/243, 244, 245, 260; 439/583; 174/88 C; 166/248; 340/854.9
See application file for complete search history.

(56) References Cited

U.S. PATENT DOCUMENTS

| | | | | |
|---|---|---|---|---|
| 4,543,548 | A * | 9/1985 | Seal et al. | 333/243 |
| 5,999,071 | A * | 12/1999 | Ostertag | 333/245 |
| 7,649,475 | B2 * | 1/2010 | Hall et al. | 340/854.9 |
| 2007/0187089 | A1 | 8/2007 | Bridges | |

* cited by examiner

*Primary Examiner* — Benny Lee
(74) *Attorney, Agent, or Firm* — Allen, Dyer, Doppelt, Milbrath & Gilchrist, P.A.

(57) ABSTRACT

A rigid radio frequency (RF) coaxial transmission line to be positioned within a wellbore in a subterranean formation may include a series of rigid coaxial sections coupled together in end-to-end relation. Each rigid coaxial section may include an inner conductor, a rigid outer conductor surrounding the inner conductor, and a dielectric therebetween. Each of the rigid outer conductors may include a rigid outer layer having opposing threaded ends defining overlapping mechanical threaded joints with adjacent rigid outer layers. Each of the rigid outer conductors may also include an electrically conductive inner layer coupled to the rigid outer layer and having opposing ends defining electrical joints with adjacent electrically conductive inner layers.

36 Claims, 9 Drawing Sheets

RF COAXIAL TRANSMISSION LINE HAVING A TWO-PIECE RIGID OUTER CONDUCTOR FOR A WELLBORE AND RELATED METHODS

FIELD OF THE INVENTION

The present invention relates to the field of radio frequency (RF) equipment, and, more particularly, to an RF coaxial transmission line, such as, for hydrocarbon resource recovery using RF heating and related methods.

BACKGROUND OF THE INVENTION

To recover a hydrocarbon resource from a subterranean formation, wellbore casings or pipes are typically coupled together in end-to-end relation within the subterranean formation. Each wellbore casing may be rigid, for example, and be relatively strong. Each wellbore casing may include steel.

To more efficiently recover a hydrocarbon resource from the subterranean formation, it may be desirable to apply radio frequency (RF) power to the subterranean formation within (or adjacent to) the hydrocarbon resource. To accomplish this, a rigid coaxial feed arrangement or transmission line may be desired to couple to a transducer in the subterranean formation. Typical commercial designs of a rigid coaxial feed arrangement are not generally designed for structural loading or subterranean use, as installation generally requires long runs of the transmission line along the lines of 500-1500 meters, for example. As an example, a typical overhead transmission line may be capable of 1,000 lbs tension, while it may be desirable for a downhole transmission line to have 150,000 to 500,000 lbs tensile capability, which may amount to 150 to 500 times the capacity of an existing commercial product.

One approach to a rigid coaxial feed arrangement uses two custom aluminum assemblies, one structural tube and one coaxial assembly therein. This approach may have a reduced cost, increased structural performance, increased ease of assembly, and increased compliance with oil field standards. Additionally, a high conductivity pipe (copper or aluminum) may be selected for a best galvanic match to a desired wellbore casing. A custom threaded aluminum coaxial transmission line may address this. However, aluminum is strength limited and generally will not handle structural load requirements without a secondary structural layer.

To address this, one approach uses a primary structural tube with a supported (floating) coaxial transmission line carried therein. The structural tube assumes the installation and operational loads.

U.S. Patent Application Publication No. 2007/0187089 to Bridges et al. is directed to a radio frequency (RF) technology heater for unconventional resources. More particularly, Bridges et al. discloses a heater assembly for heating shale oil. The heater assembly includes an inner conductor and an outer conductor or well casing electrically isolated from the inner conductor. Copper, nickel, or aluminum is coated on the interior of the outer conductor or casing to maintain temperature, increase conductivity, and maintain a robust structure.

It may thus be desirable to provide a relatively high strength coaxial transmission line for use in a subterranean formation. More particularly, it may be desirable to provide a high strength coaxial transmission using less components, and that can withstand relatively high stresses associated with hydrocarbon resource recovery in a subterranean formation.

SUMMARY OF THE INVENTION

In view of the foregoing background, it is therefore an object of the present invention to provide a relatively high strength coaxial transmission line using less components, and that can withstand relatively high stresses associated with hydrocarbon resource recovery in a subterranean formation.

This and other objects, features, and advantages in accordance with the present invention are provided by a rigid radio frequency (RF) coaxial transmission line to be positioned within a wellbore in a subterranean formation may include a series of rigid coaxial sections coupled together in end-to-end relation. Each rigid coaxial section includes an inner conductor, a rigid outer conductor surrounding the inner conductor, and a dielectric therebetween. Each of the rigid outer conductors includes a rigid outer layer having opposing threaded ends defining overlapping mechanical threaded joints with adjacent rigid outer layers. Each of the rigid outer conductors also includes an electrically conductive inner layer coupled to the rigid outer layer and having opposing ends defining electrical joints with adjacent electrically conductive inner layers. Accordingly, the rigid RF coaxial transmission line provides a high strength coaxial transmission line using less components, for example, a rigid wellbore pipe that can withstand relatively high stresses of hydrocarbon resource recovery in a subterranean formation, as part of the outer conductor.

A method aspect is directed to a method of making a rigid radio frequency (RF) coaxial transmission line section to be positioned within a wellbore in a subterranean formation and to be coupled together in end-to-end relation with adjacent RF coaxial transmission line sections. The rigid RF coaxial transmission line section includes an inner conductor, a rigid outer conductor surrounding the inner conductor, and a dielectric therebetween. The method includes providing the rigid outer conductor to include a rigid outer layer having opposing threaded ends to define overlapping mechanical threaded joints with adjacent rigid outer layers and an electrically conductive inner layer to the rigid outer layer to define electrical joints at opposing ends with adjacent electrically conductive inner layers. The method also includes positioning the inner conductor within the rigid outer conductor.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
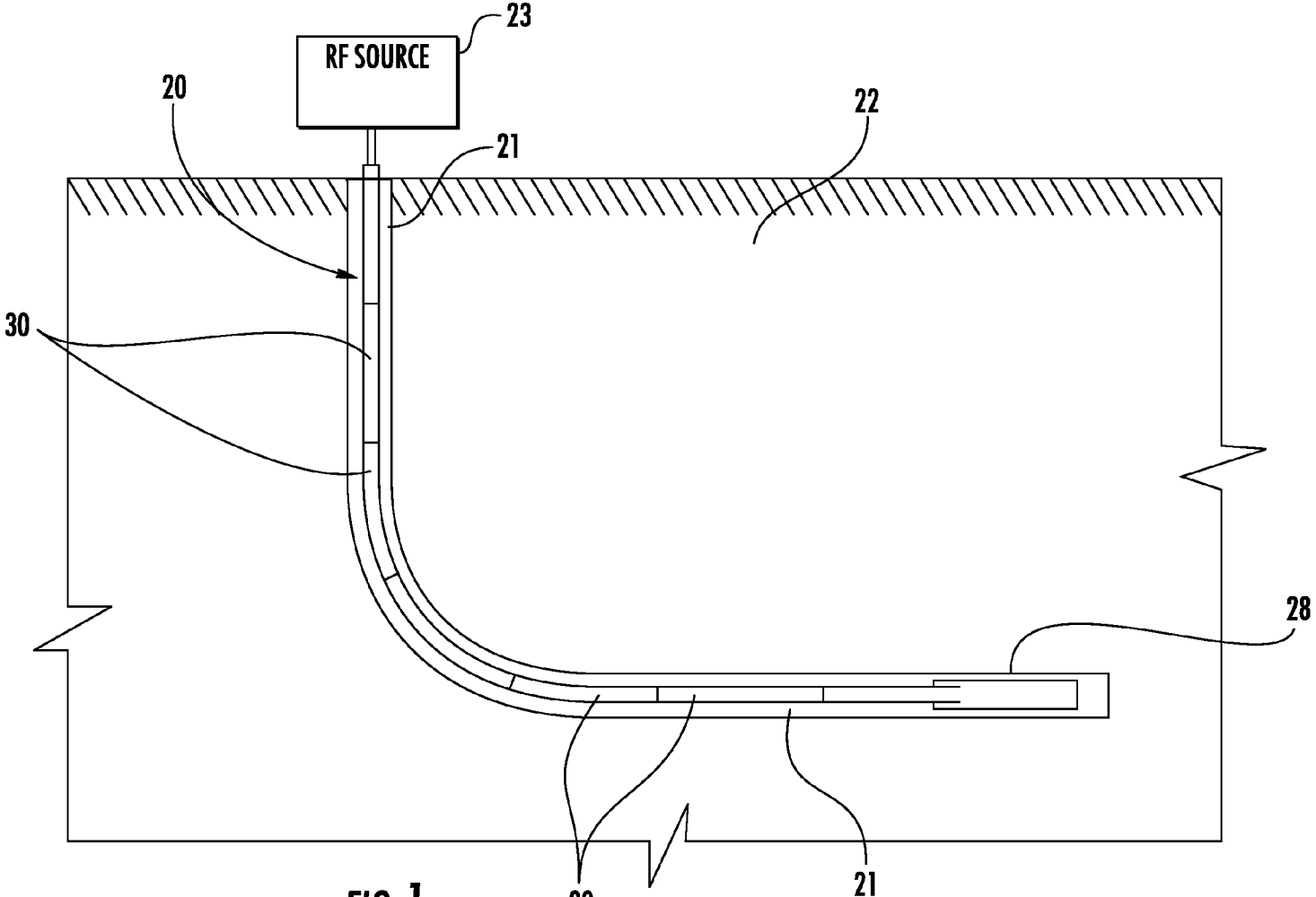
FIG. 1 is a schematic diagram of a subterranean formation including a rigid RF coaxial transmission line in accordance with the present invention.
Figure 2:
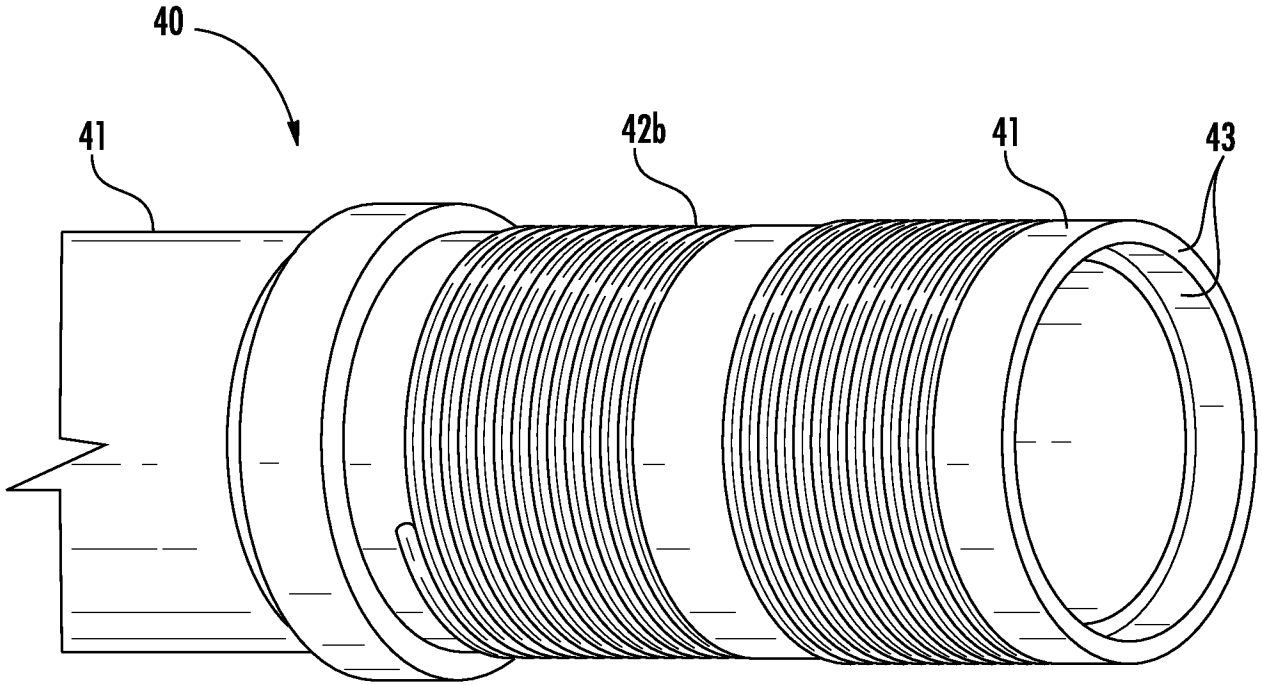
FIG. 2 is a perspective view of an end of a rigid outer conductor of a rigid coaxial section of the rigid RF coaxial transmission line of FIG. 1.
Figure 3:
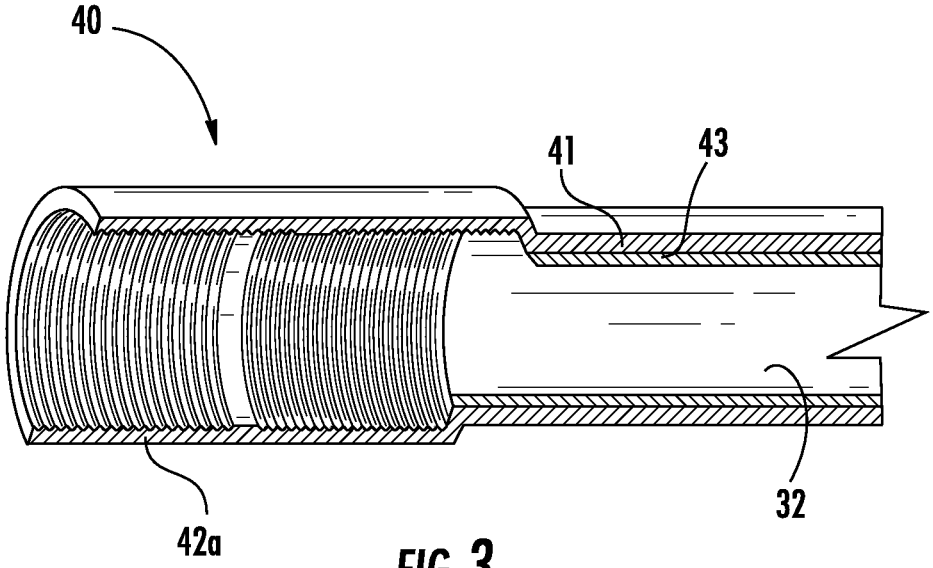
FIG. 3 is cross-section of another end of the rigid outer conductor of a rigid coaxial section of the rigid RF coaxial transmission line of FIG. 1.

Referring initially to FIG. 1, a rigid radio frequency (RF) coaxial transmission line 20 is positioned within a wellbore 21 in a subterranean formation 22. The subterranean formation 22 includes hydrocarbon resources. The wellbore 21 is illustratively in the form of a laterally extending wellbore, for example, as may be particularly advantageous for use RF assisted hydrocarbon resource recovery techniques. Of course, more than one wellbore and rigid RF coaxial transmission line may be used, and/or other techniques for hydrocarbon resource recovery may be used, for example, the steam assisted gravity drainage (SAGD) hydrocarbon resource recovery technique. A separate producer well could be positioned below the wellbore 21. The wellbore 21 could also be vertical in other embodiments.

The rigid RF coaxial transmission line 20 is coupled to an RF source 23, which is positioned at the wellhead above the subterranean formation 22. The RF source 23 cooperates with the rigid RF coaxial transmission line 20 to transmit RF energy from the RF source to the within the subterranean formation 22 adjacent the hydrocarbon resources, for example, for heating the subterranean formation. An antenna 28 is coupled to the rigid RF coaxial transmission line within the wellbore 21. The rigid RF coaxial transmission line 20 includes a series of rigid coaxial sections 30, for example, each 40 feet long, coupled together in end-to-end relation.

Figure 4:
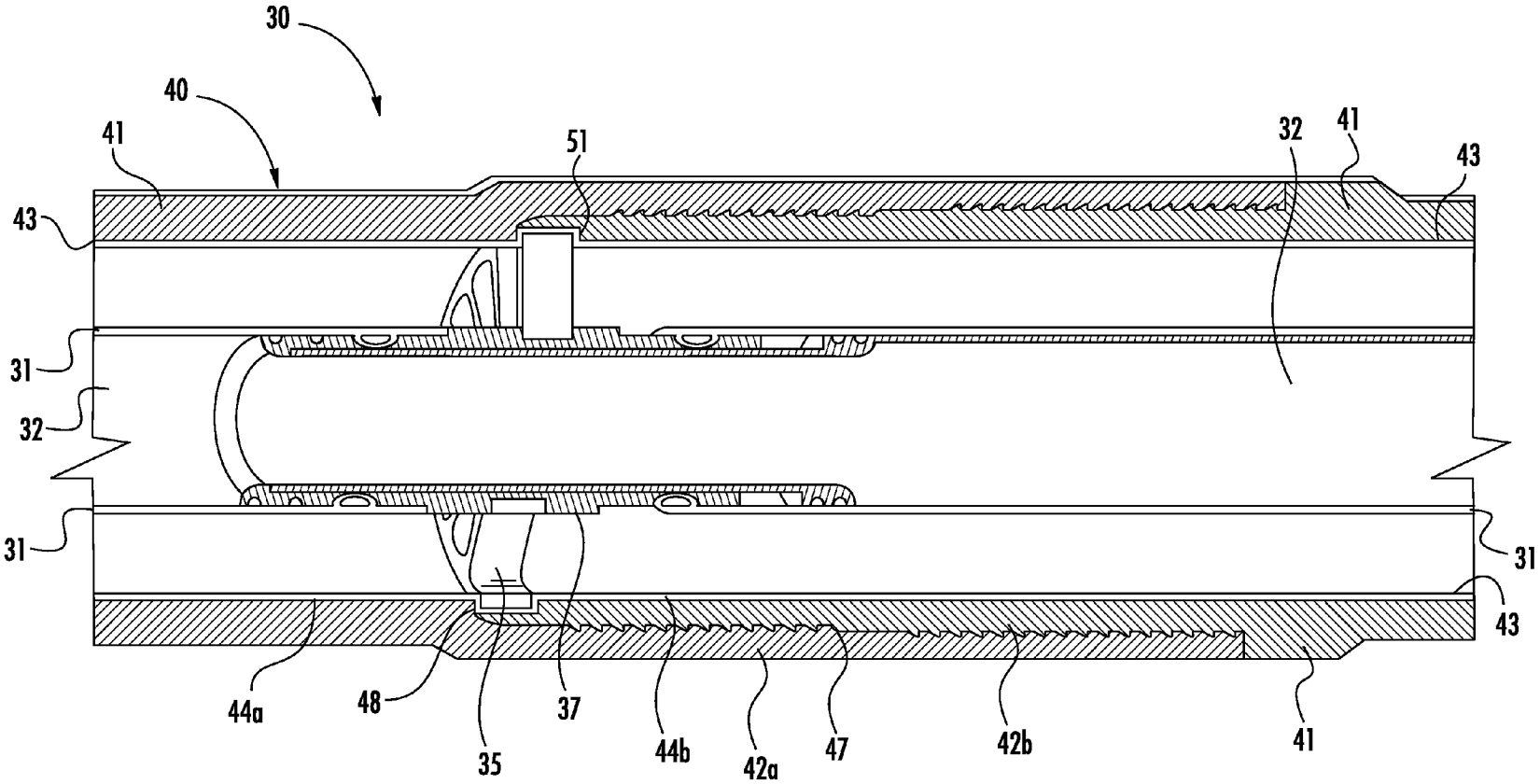
FIG. 4 is a perspective cross-sectional view of the portion of two rigid coaxial sections of FIG. 1.

Referring now additionally to FIGS. 2-5, each rigid coaxial section 30 (FIG. 4) includes an inner conductor 31 (FIG. 4), a rigid outer conductor 40 (FIGS. 2-4) surrounding the inner conductor 31, and a dielectric 32, for example, air, therebetween (FIG. 4).

Each of the rigid outer conductors 40 illustratively includes a rigid outer layer 41 having opposing threaded ends 42*a*, 42*b* (FIGS. 2 and 3) defining overlapping mechanical threaded joints 47 with adjacent rigid outer layers. The rigid outer layer 41 by itself may be a wellbore casing, which may be available from any number of manufacturers. For example, the rigid outer layer 41 may be steel or stainless steel, and may be a Grant Prideco wellbore casing available from National Oilwell Varco of Houston, Tex., or an Atlas Bradford wellbore casing available from Tenaris S.A. of Luxembourg. Advantageously, the rigid outer conductor 40 of a coaxial transmission line 20 may be formed using a commercial off the shelf (COTS) tubular or well pipe, for example. Additionally, the coupling arrangement between adjacent rigid outer conductors may include an exterior interrupt arrangement, a flush interrupt arrangement, a semi-flush interrupt arrangement, or a pin-box-pin arrangement, for example. Of course, other coupling arrangements may be used.

More particularly, the rigid outer layer 41 may have an outer diameter of 5 inches, a maximum tensile strength of 546,787 lbs/meter, and a maximum internal pressure of 12,950 psi. Of course, the rigid outer layer 41 may be another type of wellbore casing having different sizes or strength parameters. The rigid outer layer 41 by itself, while being relatively strong, may not be a relatively good conductor compared to copper, for example.

Figure 5:
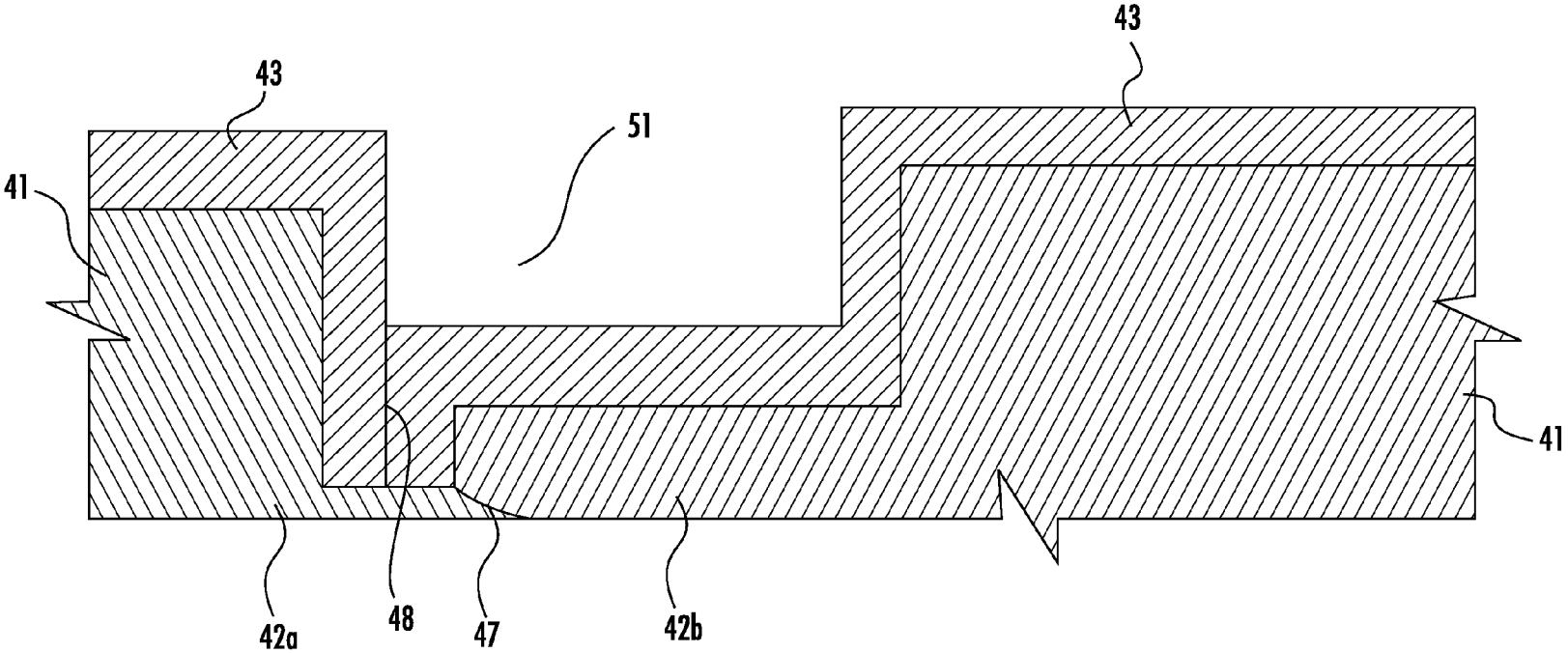
FIG. 5 is a greatly enlarged cross-sectional view of a portion of the electrical joint of FIG. 4.

Each of the rigid outer conductors 40 also includes an electrically conductive inner layer 43 coupled to the rigid outer layer 41 and having opposing ends 44*a*, 44*b* (FIG. 4) defining electrical joints 48 (FIGS. 4-5) with adjacent electrically conductive inner layers. More particularly, the electrical joints 48 may be defined by the mating of the electrically conductive inner layer 43 where the male end 42*a* of each rigid outer conductor 40 mates with the female end 42*b* of the adjacent rigid outer conductor (FIGS. 4-5). Thus, each electrical joint is an electrically conductive compression joint, making electrical contact when the threaded overlapping mechanical joints 47 are fully mated (FIGS. 4-5).

The electrically conductive inner layer 43 may be copper, for example, because of its relatively high conductivity and compatibility, as will be described in further detail below. Of course, the electrically conductive inner layer 43 may be another material, for example, aluminum, nickel, gold, brass, beryllium, or a combination thereof. The electrically conductive inner layer 43 may be relatively thin with respect to the rigid outer layer 41 and may be more than 40% more conductive than the rigid outer layer. The electrically conductive inner layer 43 is advantageously more conductive than the rigid outer layer 41 and thus may more provide a more efficient current flow. Additionally, because of the skin effect, all of the current flows in the relatively thin electrically conductive inner layer 43. In other words, the thickness of the electrically conductive inner layer 43 may correspond to the skin depth of the rigid outer conductor 40.

The rigid outer layer 41 may have a coefficient of thermal expansion (CTE) within +/−10% of a CTE of the electrically conductive inner layer 43. For example, the copper electrically conductive inner layer 43, which has a CTE at 20° C. of about 17 ($10^{-6}$/° C.) is bonded to the stainless steel rigid outer layer 41, which has a CTE of 17.3 ($10^{-6}$/° C.). In contrast, an electrically conductive inner layer of aluminum, has a CTE of 23 ($10^{-6}$/° C.) and this may be undesirable, resulting in buckling or separation of the two layers.

The strongest aluminum alloys are also less corrosion resistant due to galvanic reactions with alloyed copper. Copper takes ions from the aluminum so aluminum oxidizes in the presence of moisture. This oxidation is less of an issue since the stainless steel rigid outer layer 41 and the electrically conductive copper inner layer 43 are metallurgically compatible, thus resulting in a stronger and more robust rigid outer conductor 40.

The rigid outer layer 41 and the electrically conductive inner layer 43 are bonded together. More particularly, the rigid outer layer 41 and the electrically conductive inner layer 43 may be mechanically bonded together via hydroforming. Hydroforming is a process whereby the electrically conductive inner layer 43 is highly pressurized and plastically yielded so that it conforms tightly with the rigid outer layer 41, thus forming an adhered layer of conductive material within the rigid outer layer. The electrically conductive inner layer 43 may be slid within the rigid outer layer 41 hydroformed using water with polytetrafluoroethylene so that the electrically conductive inner layer conforms to the rigid outer layer. The rigid outer layer 41 may also be chemically bonded to the electrically conductive inner layer 43.

The rigid outer layer 41 and the electrically conductive inner layer 43 may be bonded via other techniques, for example, electroplating or electroless plating. In some embodiments, the rigid outer layer 41 may be primed, and/or an adhesive may be used to bond the electrically conductive inner layer 43 to the rigid outer layer during the hydroforming process.

Each rigid coaxial section 30 further includes a dielectric spacer 35 carried at an end of the rigid outer conductor 40 and adjacent the electrical joint 48 (FIG. 4). The dielectric spacer 35 has a bore therethrough. Each rigid coaxial section 30 also includes an inner conductor coupler 37 carried by the bore of the dielectric spacer 35 and electrically couples adjacent ends of the inner conductor 31 (FIG. 4). The rigid outer conductor 40 has a recess 51 at an end thereof receiving the dielectric spacer 35 (FIG. 5). The recess 51 may define a shoulder, for example.

Figure 6:
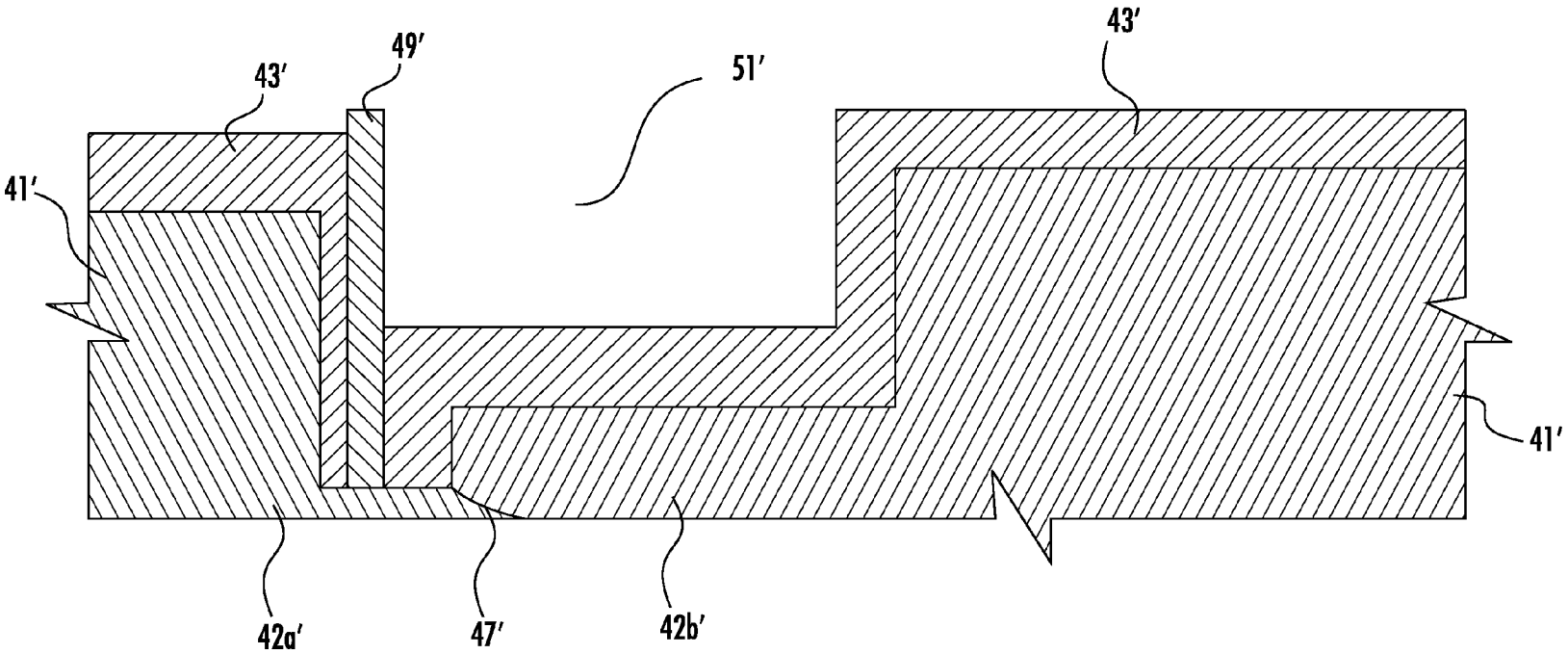
FIG. 6 is a greatly enlarged cross-sectional view of a portion of the electrical joint of a rigid RF transmission line in accordance with another embodiment of the present invention.

Referring now additionally to FIG. 6, in another embodiment, for example, each electrical joint illustratively includes an electrically conductive compression ring 49', or washer. More particularly, a brass compression ring 49' may be press fit into the stainless steel rigid outer layer 41'. The copper electrically conductive inner layer 43' is coupled to the brass compression ring 49'.

Figure 7:
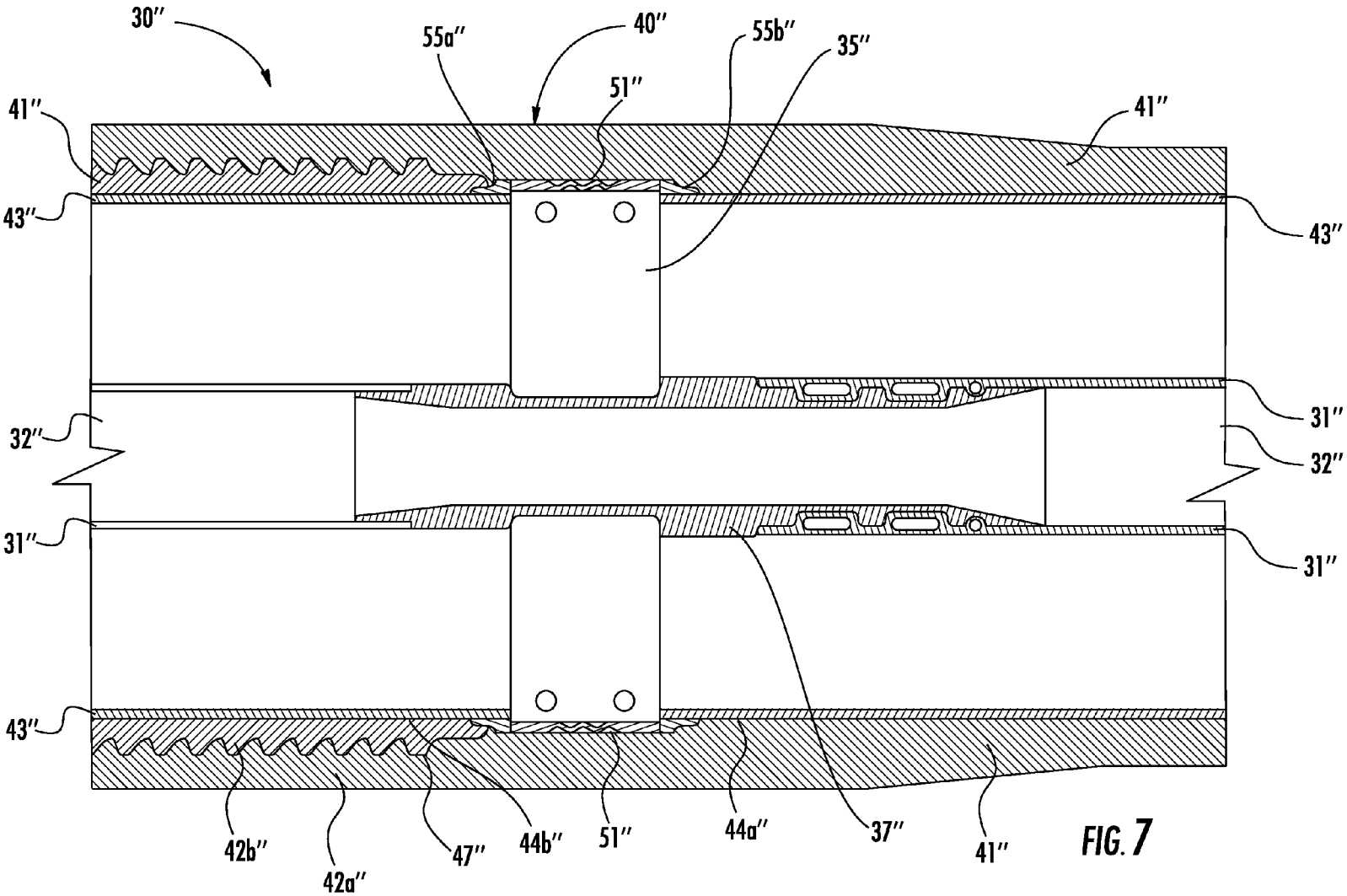
FIG. 7 is a cross-sectional view of the portion of two rigid coaxial sections according to another embodiment in accordance with the present invention.
Figure 8:
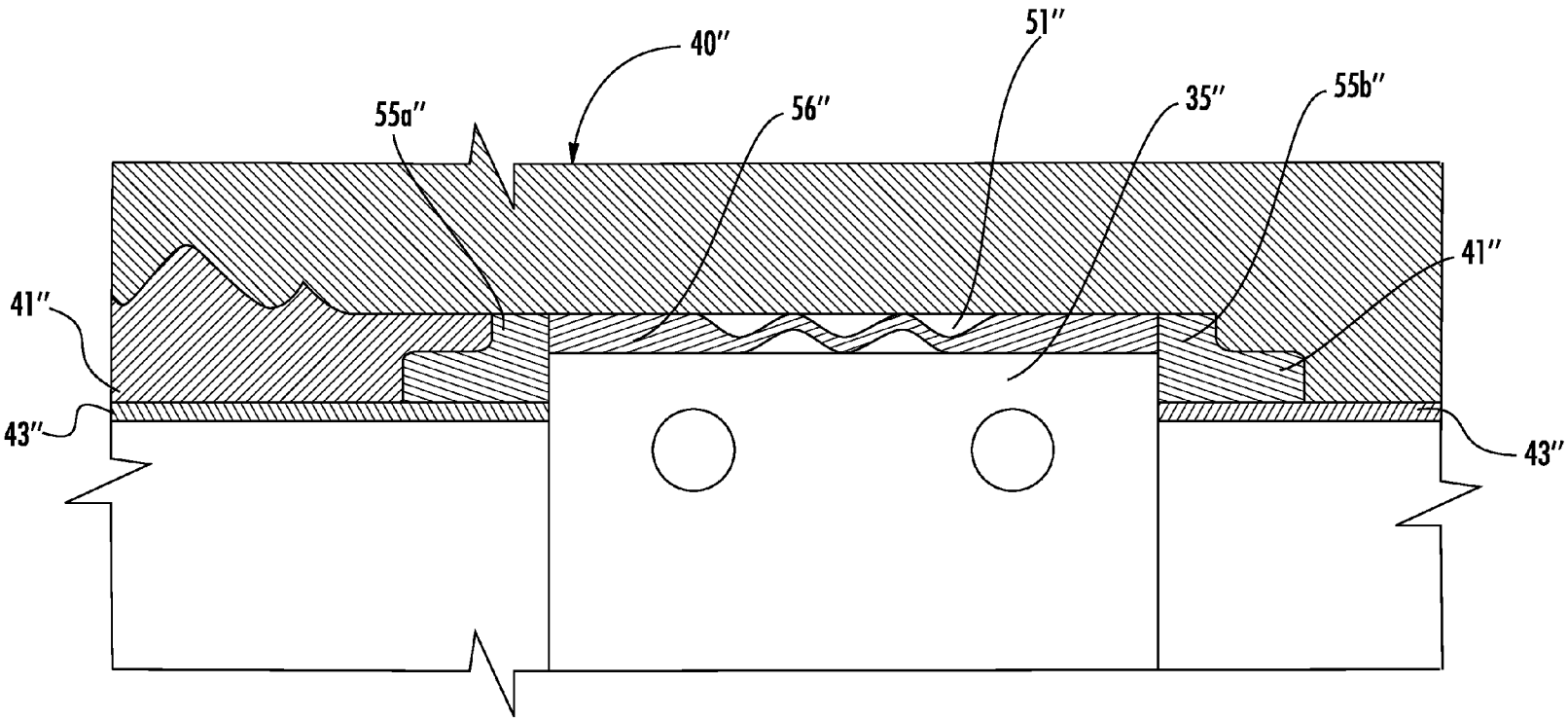
FIG. 8 is an enlarged cross-sectional view of a portion of the electrical joint of a rigid RF transmission line of FIG. 7.

Referring now additionally to FIGS. 7-8, in another embodiment, for example, each electrical joint illustratively includes an electrically conductive ring 55*a*", 55*b*" that is pressed into the rigid outer layer 41". The electrically conductive ring 55*a*", 55*b*" may be brass or beryllium-copper, for example. The electrically conductive inner conductor 43" is over the electrically conductive ring 55*a*", 55*b*" so that the electrically conductive inner conductive is flat. This may be accomplished by machining the recess 51" into the female end 42*b*" (FIG. 7) of rigid outer conductor 40".

The copper electrically conductive inner layer 43" may be hydroformed using tooling plugs that reduce expansion of the copper, for example. The electrically conductive ring 55*b*" is pressed into the female end 42*b*" of the rigid outer conductor 40" and brazed to the copper electrically conductive inner layer 43". Similarly, the electrically conductive ring 55*a*" is brazed to the electrically conductive inner layer 43" at the male end 42*a*" (FIG. 7). The face where each conductive ring 55*a*", 55*b*" is brazed to the copper electrically conductive inner layer 43" may be machined so that it is flat to receive the dielectric spacer 35" adjacent thereto. An electrically conductive spacer ring 56" (FIG. 8) is between the dielectric spacer 35" and the rigid outer conductor 40". The electrically conductive spacer ring 56" may be brass, beryllium-copper, or other material, for example, 101 copper. The electrically conductive spacer ring 56" advantageously has a corrugated shape that allows flexing as each electrical joint is compressed toward the other while maintaining electrical contact.

Figure 9:
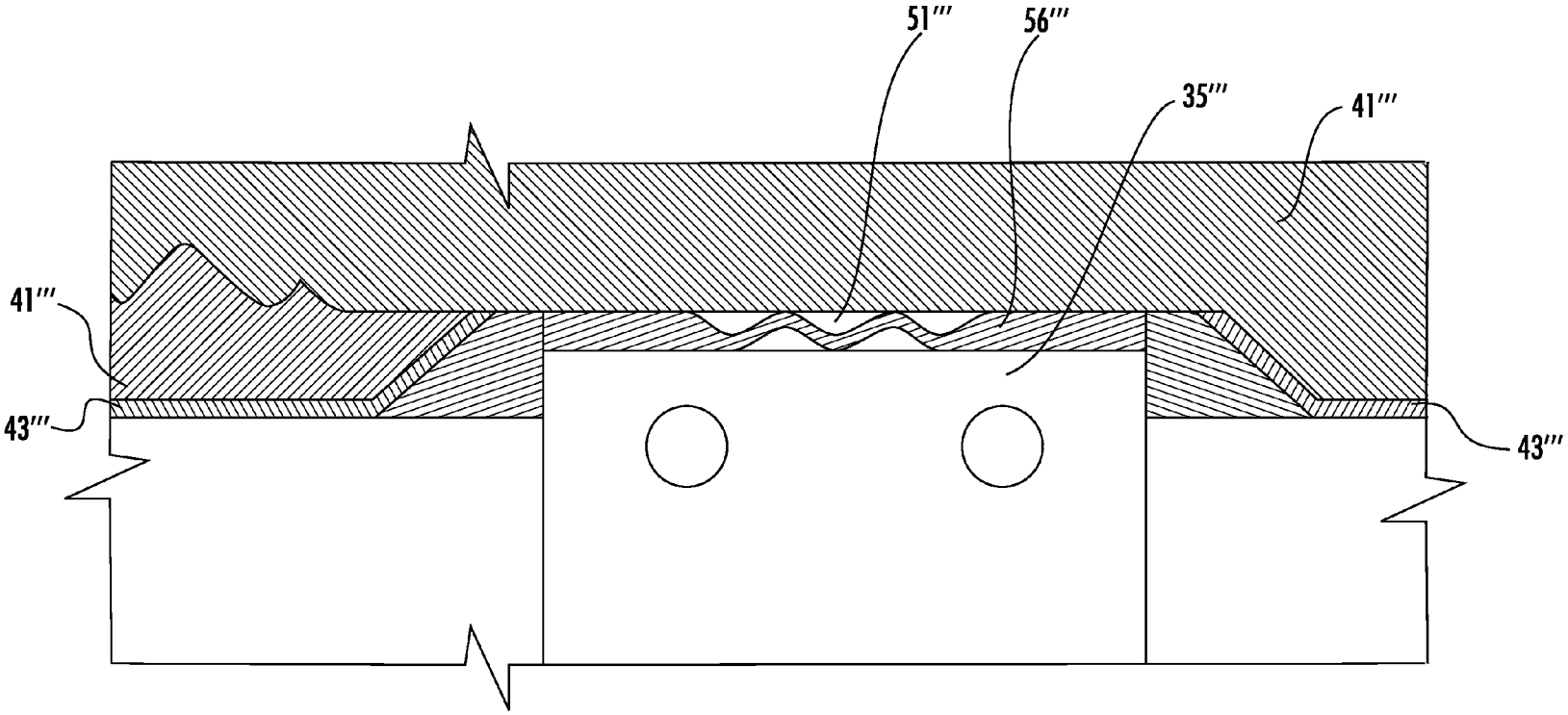
FIG. 9 is an enlarged cross-sectional view of a portion of an electrical joint of a rigid RF transmission line in accordance with an embodiment of the present invention.

Referring now additionally to FIG. 9, in another embodiment, the copper electrically conductive inner layer 43'" is flared outwardly toward the rigid outer layer 41'". More particularly, the copper electrically conductive inner layer 43'" is flared by hydroforming, for example, by the manufacturer of the rigid outer conductor 40'". The flaring advantageously allows each of the conductive rings 55*a*'", 55*b*'", to be more properly prepared for brazing to the electrically conductive inner layer 43'". Thus, the rigid RF coaxial transmission line may be more easily manufactured.

A method aspect is directed to a method of making a rigid radio frequency (RF) coaxial transmission line section 20 to be positioned within a wellbore 21 in a subterranean formation 22 and to be coupled together in end-to-end relation with adjacent RF coaxial transmission line sections. The rigid RF coaxial transmission line section 20 includes an inner conductor 31, a rigid outer conductor 40 surrounding the inner conductor, and a dielectric 32 therebetween. The method includes providing the rigid outer conductor 40 to include a rigid outer layer 41 having opposing threaded ends to define overlapping mechanical threaded joints 47 with adjacent rigid outer layers, and an electrically conductive inner layer 43 coupled to the rigid outer layer 41 to define electrical joints 48 at opposing ends with adjacent electrically conductive inner layers. As described above, the electrically conductive inner layer 43 may be coupled to the rigid outer layer 41 by hydroforming, for example. In some embodiments, the electrically conductive inner layer 43 may be coupled to the rigid outer layer 41 via electroplating or electroless plating, for example. In other embodiments, an adhesive may be positioned between the electrically conductive inner layer 43 and the rigid outer layer 41. The method also includes positioning the inner conductor 31 within the rigid outer conductor 40.

As will be appreciated by those skilled in the art, the rigid RF coaxial transmission line 20 advantageously uses a commercially available (COTS) tubular, well or drill pipe with known mechanical properties, which includes standard drill and installation interfaces, and common pipe accessories (cable clamps, centralizers, joint protectors, etc.) to form a relatively high power and high strength coaxial transmission line. Thus, cost of an antenna element is reduced. Strength is also increased, for example, by maintaining use of the rigid outer layer, which may be stainless steel, for example. Also, by modifying a COTS tubular, compliance with oil field standards may be maintained. Moreover, assembly time, for example, for assembling an RF based hydrocarbon resource recovery system, may be reduced.

Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A rigid radio frequency (RF) coaxial transmission line comprising:

a series of rigid coaxial sections coupled together in end-to-end relation, each rigid coaxial section comprising an inner conductor, a rigid outer conductor surrounding said inner conductor, and a dielectric therebetween;

each of said rigid outer conductors comprising a rigid outer layer having opposing threaded ends defining overlapping mechanical threaded joints with adjacent rigid outer layers, and an electrically conductive inner layer lining and in contact with said rigid outer layer and having opposing ends defining electrical joints with adjacent electrically conductive inner layers.

2. The rigid RF coaxial transmission line according to claim 1, wherein each electrical joint comprises an electrically conductive compression joint.

3. The rigid RF coaxial transmission line according to claim 2, wherein each electrically conductive compression joint further comprises an electrically conductive compression ring.

4. The rigid RF coaxial transmission line according to claim 1, wherein said rigid outer layer and said electrically conductive inner layer are bonded together.

5. The rigid RF coaxial transmission line according to claim 1, wherein each rigid coaxial section further comprises:

a dielectric spacer carried at an end of said rigid outer conductor and having a bore therethrough; and an inner conductor coupler carried by the bore of said dielectric spacer and electrically coupling adjacent ends of said inner conductor.

6. The rigid RF coaxial transmission line according to claim 5, wherein said rigid outer conductor has a recess at an end thereof receiving said dielectric spacer.

7. The rigid RF coaxial transmission line according to claim 5, wherein the electrical joint is adjacent said dielectric spacer.

8. The rigid RF coaxial transmission line according to claim 1, wherein said conductive inner layer comprises at least one of copper, aluminum, nickel, gold, and beryllium.

9. The rigid RF coaxial transmission line according to claim 1, wherein said rigid outer layer comprises at least one of steel, and stainless steel.

10. A rigid radio frequency (RF) coaxial transmission line comprising:

a series of rigid coaxial sections coupled together in end-to-end relation, each rigid coaxial section comprising an inner conductor, a rigid outer conductor surrounding said inner conductor, and a dielectric therebetween;

each of said rigid outer conductors comprising a rigid outer layer having opposing threaded ends defining overlapping mechanical threaded joints with adjacent rigid outer layers, and an electrically conductive inner layer lining and in contact with said rigid outer layer and having opposing ends defining electrical joints with adjacent electrically conductive inner layers, said rigid outer layer having a coefficient of thermal expansion (CTE) within +/−10% of a CTE of said electrically conductive inner layer.

11. The rigid RF coaxial transmission line according to claim 10, wherein each electrical joint comprises an electrically conductive compression joint.

12. The rigid RF coaxial transmission line according to claim 11, wherein each electrically conductive compression joint further comprises an electrically conductive compression ring.

13. The rigid RF coaxial transmission line according to claim 10, wherein said rigid outer layer and said electrically conductive inner layer are bonded together.

14. The rigid RF coaxial transmission line according to claim 10, wherein each rigid coaxial section further comprises:

a dielectric spacer carried at an end of said rigid outer conductor and having a bore therethrough; and an inner conductor coupler carried by the bore of said dielectric spacer and electrically coupling adjacent ends of said inner conductor.

15. A method of making a rigid radio frequency (RF) coaxial transmission line section to be positioned within a wellbore in a subterranean formation and to be coupled together in end-to-end relation with adjacent RF coaxial transmission line sections, the rigid RF coaxial transmission line section comprising an inner conductor, a rigid outer conductor surrounding the inner conductor, and a dielectric therebetween, the method comprising:

providing the rigid outer conductor to comprise a rigid outer layer having opposing threaded ends to define overlapping mechanical threaded joints with adjacent rigid outer layers, and an electrically conductive inner layer hydroformed to the rigid outer layer to define electrical joints at opposing ends with adjacent electrically conductive inner layers; and positioning the inner conductor within the rigid outer conductor.

16. The method according to claim 15, wherein providing the rigid outer conductor comprises providing the rigid outer layer and the electrically conductive inner layer coupled to the rigid outer layer to define electrically conductive compression joints at opposing ends with adjacent electrically conductive inner layers.

17. The method according to claim 15, further comprising positioning the rigid radio frequency (RF) coaxial transmission line section within a wellbore in a subterranean formation.

18. A method of making a rigid radio frequency (RF) coaxial transmission line section to be positioned within a wellbore in a subterranean formation and to be coupled together in end-to-end relation with adjacent RF coaxial transmission line sections, the rigid RF coaxial transmission line section comprising an inner conductor, a rigid outer conductor surrounding the inner conductor, and a dielectric therebetween, the method comprising:

providing the rigid outer conductor to comprise a rigid outer layer having opposing threaded ends to define overlapping mechanical threaded joints with adjacent rigid outer layers, and an electrically conductive inner layer lining and in contact with the rigid outer layer to define electrical joints at opposing ends with adjacent electrically conductive inner layers; and positioning the inner conductor within the rigid outer conductor.

19. The method according to claim 18, wherein providing the rigid outer conductor comprises providing the rigid outer layer and the electrically conductive inner layer coupled to the rigid outer layer to define electrically conductive compression joints at opposing ends with adjacent electrically conductive inner layers.

20. The method according to claim 18, wherein providing the rigid outer conductor comprises providing the rigid outer conductor to comprise the electrically conductive inner layer bonded to the rigid outer layer.

21. The method according to claim 18, further comprising positioning the rigid radio frequency (RF) coaxial transmission line section within a wellbore in a subterranean formation.

22. A rigid radio frequency (RF) coaxial transmission line section and operable to be coupled together in end-to-end relation with adjacent RF coaxial transmission line sections, the rigid RF coaxial transmission line section comprising:

an inner conductor;

a rigid outer conductor surrounding said inner conductor; and a dielectric therebetween;

said rigid outer conductor comprising a rigid outer layer having opposing threaded ends to define overlapping mechanical threaded joints with adjacent rigid outer layers, and an electrically conductive inner layer lining and in contact with said rigid outer layer and having opposing ends to define electrical joints with adjacent electrically conductive inner layers.

23. The rigid RF coaxial transmission line section according to claim 22, wherein each electrical joint comprises an electrically conductive compression joint.

24. The rigid RF coaxial transmission line section according to claim 23, wherein each electrically conductive compression joint further comprises an electrically conductive compression ring.

25. The rigid RF coaxial transmission line section according to claim 22, wherein said rigid outer layer and said electrically conductive inner layer are bonded together.

26. The rigid RF coaxial transmission line section according to claim 22, further comprising:

a dielectric spacer carried at an end of said rigid outer conductor and having a bore therethrough; and an inner conductor coupler carried by the bore of said dielectric spacer and electrically coupling adjacent ends of said inner conductor.

27. The rigid RF coaxial transmission line section according to claim 26, wherein said rigid outer conductor has a recess at an end thereof receiving said dielectric spacer.

28. The rigid RF coaxial transmission line section according to claim 26, wherein one of the electrical joints is adjacent said dielectric spacer.

29. A rigid radio frequency (RF) coaxial transmission line comprising:

a series of rigid coaxial sections coupled together in end-to-end relation, each rigid coaxial section comprising an inner conductor, a rigid outer conductor surrounding said inner conductor, and a dielectric therebetween;

each of said rigid outer conductors comprising an electrically conductive rigid outer layer having opposing threaded ends defining overlapping mechanical threaded joints with adjacent electrically conductive rigid outer layers, and an electrically conductive inner layer coupled to said electrically conductive rigid outer layer, having opposing ends defining electrical joints with adjacent electrically conductive inner layers, and having an electrically conductivity greater than an electrical conductivity of said electrically conductive rigid layer.

30. The rigid RF coaxial transmission line according to claim 29, wherein each rigid coaxial section further comprises:

a dielectric spacer carried at an end of said electrically conductive rigid outer conductor and having a bore therethrough; and an inner conductor coupler carried by the bore of said dielectric spacer and electrically coupling adjacent ends of said inner conductor.

31. The rigid RF coaxial transmission line according to claim 29, wherein said electrically conductive rigid outer layer and said electrically conductive inner layer are bonded together.

32. The rigid RF coaxial transmission line according to claim 29, wherein each electrical joint comprises an electrically conductive compression joint.

33. The rigid RF coaxial transmission line according to claim 32, wherein each electrically conductive compression joint further comprises an electrically conductive compression ring.

34. A method of making a rigid radio frequency (RF) coaxial transmission line section to be positioned within a wellbore in a subterranean formation and to be coupled together in end-to-end relation with adjacent RE coaxial transmission line sections, the rigid RF coaxial transmission line section comprising an inner conductor, a rigid outer conductor surrounding the inner conductor, and a dielectric therebetween, the method comprising:

providing the rigid outer conductor to comprise a rigid outer layer having opposing threaded ends to define overlapping mechanical threaded joints with adjacent rigid outer layers, and an electrically conductive inner layer plated to the rigid outer layer to define electrical joints at opposing ends with adjacent electrically conductive inner layers; and positioning the inner conductor within the rigid outer conductor.

35. The method according to claim 34, wherein providing the rigid outer conductor comprises providing the rigid outer layer and the electrically conductive inner layer coupled to the rigid outer layer to define electrically conductive compression joints at opposing ends with adjacent electrically conductive inner layers.

36. The method according to claim 34, further comprising positioning the rigid radio frequency (RF) coaxial transmission line section within a wellbore in a subterranean formation.

* * * * *